US005833349A

United States Patent [19]

Apple

[11] Patent Number: 5,833,349

[45] Date of Patent: Nov. 10, 1998

[54] PHOSPHORESCENT LAMP SHADE

[76] Inventor: Wayne B. Apple, 14738 Bronson Ave., San Jose, Calif. 95124

[21] Appl. No.: 958,754

[22] Filed: Oct. 25, 1997

[51] Int. Cl.[6] ..... F21V 9/16

[52] U.S. Cl. ..... 362/84; 362/311; 362/351; 362/806

[58] Field of Search ..... 362/84, 124, 351, 362/806, 808, 255; 493/950; 250/462.1, 466.1

[56] References Cited

U.S. PATENT DOCUMENTS 2,000,985 4/1935 Quinlan et al. ..... 362/84
5,143,438 9/1992 Giddens ..... 362/84
5,408,396 4/1995 Stanley .
5,462,930 10/1995 Brown, Sr. ..... 362/124
5,654,552 8/1997 Toombs .

*Primary Examiner*—Thomas M. Sember
*Attorney, Agent, or Firm*—Robert Samuel Smith

[57] ABSTRACT

A lamp having a lamp shade that phosphesces after the light from the bulb is extinguished. The glowing lamp shade provides a low level light that comforts children who are afraid of total darkness and allows them to drift off to sleep. The life of the afterglow is preferably about twenty minutes to half an hour. Decoration is developed on the surface of the lamp shade by painting opaque designs or attaching opaque paper or cloth on the surace of the lampshade.

12 Claims, 2 Drawing Sheets

PHOSPHORESCENT LAMP SHADE

FIELD OF THE INVENTION

This invention relates to lamp shades and especially to lamp shades that glow in the dark after the light has been turned off.

BACKGROUND AND INFORMATION DISCLOSURE

Luminescent materials are materials that emit light by a process other than heating the body. Such materials are generally stimulated by light shining on the material and are said to fluoresce. Phosphorescent materials are luminescent materials that continue to glow for a while after the incident light is turned off.

Phosphors are luminescent materials that have been prepared artificially. The phosphorescence of different phosphors persists at diminishing intensity, for periods ranging from a few microseconds to a number of hours. Alkaline earth sulfides may be selected having decay times of the order of an hour, more or less.

Luminescent plastics have been developed. Numerous applications have been conceived for luminescent paint and plastic materials.

For example U.S. Pat. No. 5,406,463 to Schexnayder disclosed a sign display having informational indicia and using chemiluminescense to provide illumination from within the indicia.

U.S. Pat. No. 5,654,552 to Toombs discloses a glow in the dark lamp shade including a translucent lamp shade having a "region which includes a glow-in-the-dark substance". The glow-in the-dark substance comprises a "glow-in-the dark ink applied to a cloth layer that is bonded to a transparent plastic layer of the lamp shade". The Toombs invention has several shortcomings that are overcome by the present invention. One shortcoming is that glow-in-the dark ink or substance must itself be translucent and this restricts the selection of inks and the depth and hue of colors that may be used to decorate the lamp shade. A second shortcoming is that if it be required to provide as much illumination as possible inside the lamp shade, then the Toombs construction would inherently provide less "glow" inside the lamp shade after the light is turned off than is provided by the present invention.

U.S. Pat. No. 5,596,821 disclosed a utility article attachable to footwear (sneakers, shoes, skates).

U.S. Pat. No. 5,408,396 to Dolph disclosed a fish lure.

"Night lights" are lights available in the marketplace that are intended to fill needs where a dim light is need rather than a bright light. For example, one such need is in a child's bedroom. Many children are afraid of or do not like the dark. They insist on having a light on that gives them comfort while they are falling asleep. Another need occurs in a room full of furniture where a person (particularly an elderly person) wishes to turn out the light and then must grope his way through the darkened room to a doorway exit. That same person may be required to turn out a light at a foot of a stairs and be required to grope for a handrail to aid in climbing the stairs.

One problem is that night light must remain on all night long unless someone turns it off. Oftentimes, the night light is not noticed in the morning when the sun comes up and the user forgets to turn off the night light, leaving it on all day long. This is wasteful and burns out the light. The night light will eventually burn out and replacing the bulb of the night light is a nuisance.

When used in a child's bedroom, the brightness of the night light may prolong the length of time required for the child to fall asleep.

One remedy to the problem of limiting the "on" time of the night light is to plug the night light into a timer that turns the light off after a set period However, this method of solving the problems is generally more expensive than the solution is worth.

Another shortcoming is that such lights usually plug into a wall socket and the wall socket is usually not conveniently located. Night lights that plug into a wall socket are not especially attractive.

SUMMARY OF THE INVENTION

It is an object of this invention to provide a lamp shade that emits a low level of light for an appropriate period of time after the lamp is "turned off". It is another object of this invention that the low level of light gradually diminish to complete darkness after a period of time that is appropriate for its purpose. It is another object that the lamp shade be a decorative addition to the room. It is another object that the use of the lamp and lamp shade eliminate the inconveniences and shortcoming discussed above. It is another object of this invention that the lamp shade be adapted for use with a large number of different lamps such that the user may choose his/her lamp independent of the lamp shade and according to his taste.

This invention is directed toward a a lamp shade that is fabricated from translucent plastic sheet containing a phosphoescent that will fluoresce for a limited period of time after the lamp light has been extinguished. Particularly when intended for a child's room, the lamp shade may have interesting decorations on the lamp shade such as animal figures or well known cartoon characters. The decorations are imposed on the lamp shade by opaque paint or figures that are "paper cutouts" and may be created by the child him/herself. In one embodiment, the lamp base has figures separate from the lamp shade mounted on the lamp base.

DESCRIPTION OF BEST MODES

Figure 1:
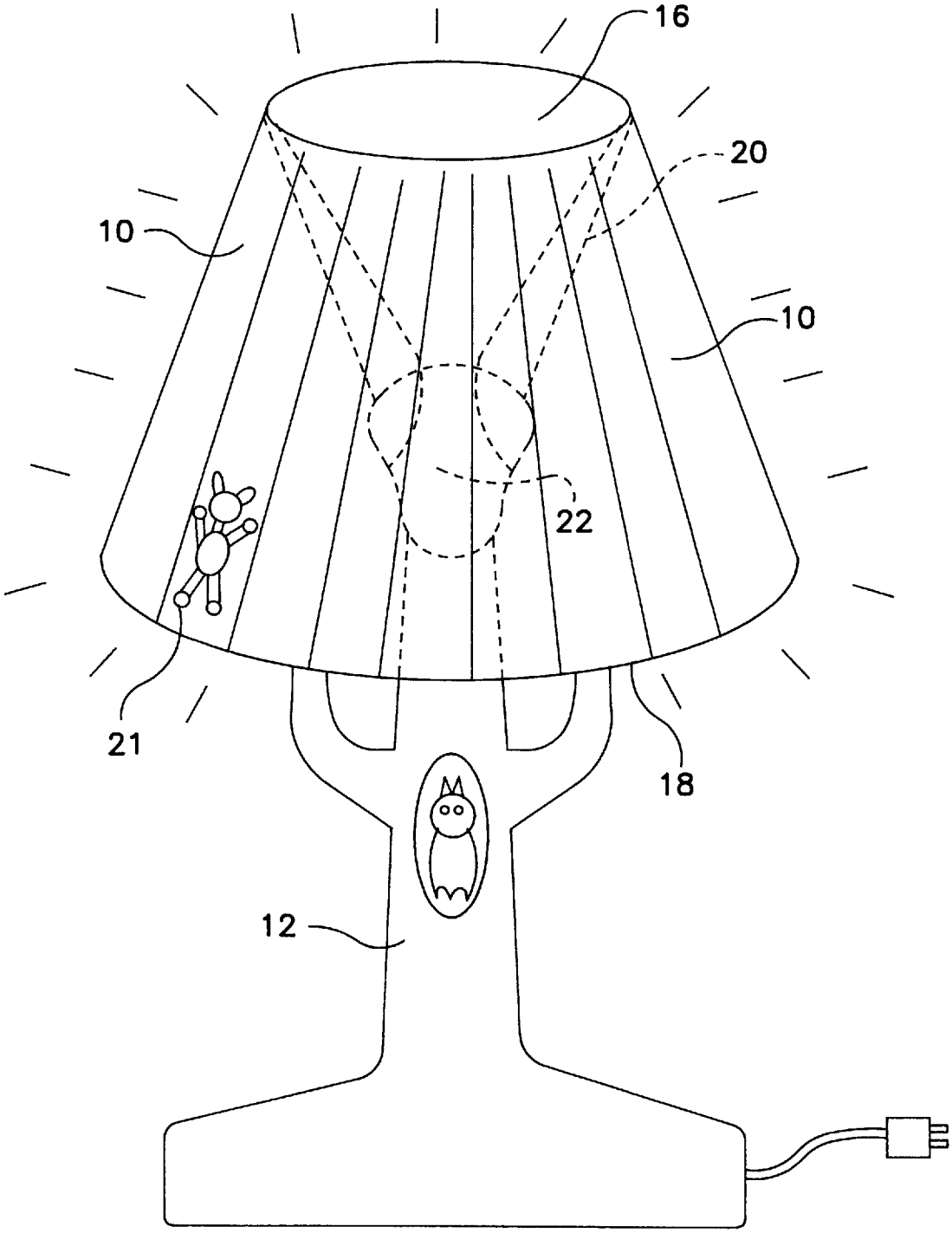
FIG. 1 shows a lamp shade with open top and having an opaque figure painted on its side..

Turning now to a discussion of the drawings, FIG. 1 shows the lamp shade 10 of this invention mounted on a lamp base 12. The lamp shade 10 is fabricated from a clear plastic sheet containing a phosphorescent additive distributed uniformly throughout the sheet. Preferably the plastic is a translucent thermoplastic such as clear polyvinyl chloride or polyethylene containing a phosphorescent additive.

The formed plastic sheet 10 may have one of a variety of shapes or configurations such as a frustum of a cone as shown in FIG. 1 or a cylinder (not shown) or a rectangle (not shown), each having an open top and bottom. Alternatively, the lamp shade (cover) may have a closed top as shown by the umbrella configuration in FIG. 2.

A phosphorescent additive having a decay time of about one half hour is sold under the trade name "Phosphorescent" by the Crescent Bronze Co. "Phosphorescent" emits a warm yellow-green light after the lamp is turned off. Various phosphorescent additives are available having a life time of between five to sixty minutes and may be selected according to the requirements of the user. The translucent property of the lamp shade material enables the light to irradiate from inside through the lamp shade so that, when the lamp is extinguished, the lamp shade phosphoresces from the outside surface as well as from the entire inner surface.

In the context of this specification, the term "translucent" should be understood to mean "light conducting" and includes clear plastic.

When the lamp shade is intended for a child's room, the lamp shade may have opaque figures such as cartoon character 21 on the shade. The FIG. 21 may be an opaque paint or cutout of opaque paper or cloth. The child is comforted by the warm glow of the lamp shade with familiar figures as he/she drifts off to sleep.

As shown in FIG. 1, the lamp shade may be provided with a wire frame 20 (shown in phantom in FIG. 1) that supports the lamp shade 10 on the light bulb 22.

Figure 2:
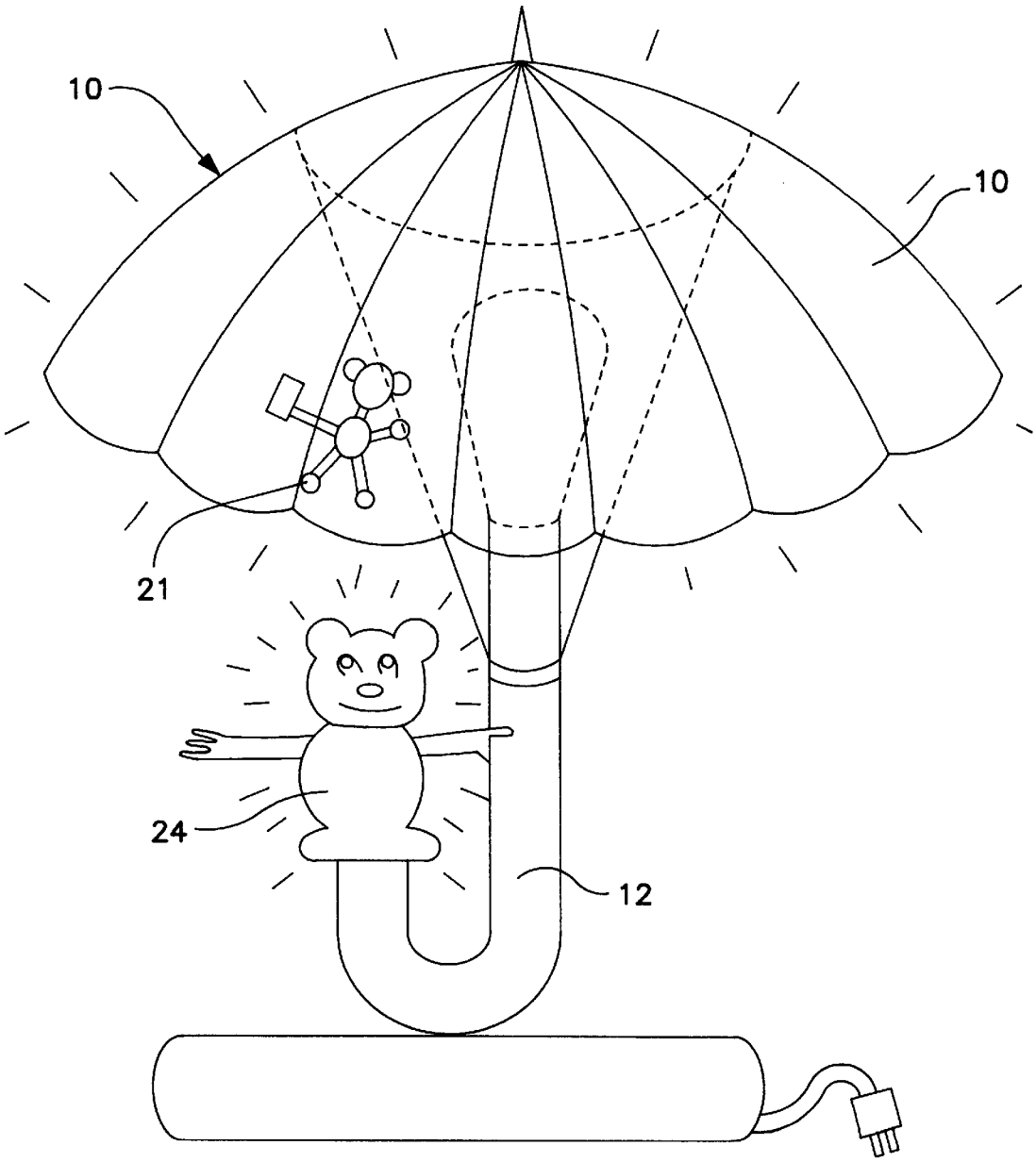
FIG. 2 shows a lamp shade with closed top.

As shown in FIG. 2, the lamp shade 10 may be supported by a wire frame 26 (in phantom) supported on the lamp base.

There has been described a lamp shade that is fabricated from luminescent translucent plastic that will fluoresce for a limited period of time after the lamp light has been extinguished. Particularly when intended for a child's room, the lamp shade may have interesting decorations on the lamp shade such as animal figures or well known cartoon characters. The decorations may be imposed on the translucent lamp shade by opaque paint or figures that are "paper cutouts" and may be created by the child him/herself. The opaque paint may be a washable paint so that the designs may be renewed according to the whims of the user. Since the entire inner surface of the lamp will glow, maximum illumination is generated within the lamp shade so that objects within the lamp shade such as the light switch may be easily located after the light has been turned out being irradiated by glow from the entire interior surface of the lamp shade.

Various modifications may be suggested by reading the specification and studying the drawings which are within the scope of the invention.

For example, in FIG. 2, a FIG. 24 painted with phosphescent paint is mounted on the lamp base base.

The lamp shade may have sides forming a conical or pyramidal frustum, or a cylinder or a square bottomless open box. The sides of the lamp shade may be pleated.

In view of these and other modifications that may occur after reading the specification and studying the drawings, I wish to define the scope of my invention by the appended claims.

I claim:

1. A lamp shade for positioning over a lamp that presents a dark outline shape of a figure that is viewable to a viewer, said lamp shade comprising:

a translucent plastic sheet formed into one of:

(a) a frustum having an open top and open bottom;

(b) a cover;

an entire area of said plastic sheet containing phosphorescent additive;

means for supporting said formed plastic sheet over at least one light bulb;

said phosphorescent additive dispersed substantially uniformly throughout said entire translucent plastic sheet providing that said sheet glows for a period of time after said at least one light bulb is extinguished;

a region of said plastic sheet covered by opaque material having the outline shape that is decorative to the viewer of said lamp shade providing that said lampshade phosphoresces and renders said outline shape viewable to said viewer for a period of time after said lamp is extinguished.

2. The lamp shade of claim 1 wherein said translucent material is one of:

(a) polyethylene;

(b) polyvinyl chloride;

(c) ethyl acetate;

(d) polystyrene;

(e) polypropylene.

3. The lamp shade of claim 1 wherein said period of time is one of a range of periods between five and sixty minutes.

4. The lamp shade of claim 3 wherein said phosphorescent additive is a sulfide compound.

5. The lamp shade of claim 1 wherein said frustum is one of:

(a) a cylinder; with one edge forming said open top and another edge forming said open bottom;

(b) a conical frustum with one edge forming said open top and another edge forming said open bottom;

(c) a rectangular box with one edge forming said open top and another edge forming said open bottom.

6. The lamp shade of claim 1 wherein said means for supporting comprises a wire frame having one end supporting said lamp shade and another end mountable on one of;

(a) a lamp base;

(b) at least one light bulb.

7. The lamp shade of claim 1 wherein said opaque coat comprises one of:

(a) an opaque paint;

(b) a paper cutout;

(c) a clothe cutout.

8. A lamp comprising:

the lamp shade of claim 1;

a lamp base;

said means for supporting said lamp shade includes means for supporting said lamp shade on said lamp base.

9. The lamp of claim 8 wherein said means for supporting further comprises a frame extending from said lamp base and supporting said lamp shade.

10. The lamp of claim 9 wherein said means for supporting is one of:

(a) a wire frame engaging said at least one light bulb and supporting said lamp shade;

(b) a frame extending from said lamp base and supporting said lamp shade.

11. The lamp of claim 9 which comprises a decorative figure supported on said base.

12. The lamp of claim 11 wherein said figure comprises an exterior phosphorescent surface.

* * * * *